US007621778B1

(12) United States Patent
Paynter et al.

(10) Patent No.: US 7,621,778 B1
(45) Date of Patent: Nov. 24, 2009

(54) COAXIAL CONNECTOR INNER CONTACT ARRANGEMENT

(75) Inventors: Jeffrey Paynter, Momence, IL (US); James Wlos, Crete, IL (US)

(73) Assignee: Commscope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 12/181,022

(22) Filed: Jul. 28, 2008

(51) Int. Cl.
*H01R 9/05* (2006.01)

(52) U.S. Cl. ..... 439/584

(58) Field of Classification Search ..... 439/578–585
See application file for complete search history.

(56) References Cited

U.S. PATENT DOCUMENTS 5,281,167 A 1/1994 Le et al.
5,509,821 A 4/1996 Small et al.
5,576,675 A 11/1996 Oldfield
5,785,554 A 7/1998 Ohshiro
6,396,367 B1 5/2002 Rosenberger
6,802,739 B2 10/2004 Henningsen
6,824,415 B2 11/2004 Wlos
6,835,095 B2 12/2004 Chen
7,011,546 B2 3/2006 Vaccaro
7,077,700 B2 7/2006 Henningsen
7,104,839 B2 9/2006 Henningsen
7,121,883 B1 10/2006 Petersen et al.
7,144,272 B1 12/2006 Burris et al.
7,156,696 B1 1/2007 Montena
7,163,420 B2 1/2007 Montena
7,179,121 B1 2/2007 Burris et al
7,335,059 B2 2/2008 Vaccaro
7,381,089 B2 6/2008 Hosler, Sr.

*Primary Examiner*—Javaid Nasri
(74) *Attorney, Agent, or Firm*—Babcock IP, PLLC

(57) ABSTRACT

An inner contact arrangement for a coaxial cable connector. The inner contact supported coaxially within a connector bore of the connector by a support insulator. A plurality of tines extending from a central portion of the inner contact, the tines may be angled outward from a longitudinal axis of the inner contact and or provided with a shoulder. A bias insulator with a ramp bore, the bias insulator retained within the connector bore and contacting the cable end of the tines.

19 Claims, 6 Drawing Sheets

COAXIAL CONNECTOR INNER CONTACT ARRANGEMENT

BACKGROUND OF THE INVENTION

1. Field of the Invention

The invention relates to connectors for coaxial cable. More particularly the invention relates to an inner conductor contact arrangement with improved inner conductor dimensional variance capacity, assembly characteristics and electrical performance.

2. Description of Related Art

The inner conductor contact of a coaxial connector couples with the inner conductor of a coaxial cable. Surrounded by the connector body and/or mechanical connections between the connector body and the outer conductor of the coaxial cable, the inner conductor contact is typically formed with a plurality of spring fingers biased inward to securely grasp the outer diameter of the inner conductor as it is inserted between them during interconnection of the connector and cable.

Spring fingers, alone, provide an interconnection with the inner conductor having limited strength characteristics, unless the spring fingers are dimensionally large, which introduces an impedance discontinuity to the resulting connector. Further, assembly becomes increasingly difficult as the spring finger inward bias is increased to achieve a correspondingly stronger interconnection with the inner conductor. Also, high bias spring fingers increase the possibility that the spring fingers will scrape the inner conductor during insertion, which increases the chance for generation of passive intermodulation (PIM) distortion.

U.S. Pat. No. 7,335,059 titled "Coaxial Connector Including Clamping Ramps and Associated Method", issued Feb. 26, 2008 to Vaccaro, owned by CommScope, Inc. of North Carolina as is the present application, discloses a connector incorporating an insulator movable along the connector longitudinal axis having an outer diameter shaped to assist with flaring of the outer conductor and an inner diameter shaped as a wedge surface to progressively engage a cable end of the inner contact spring fingers, progressively biasing the spring fingers inward against the inner conductor as the inner conductor is inserted between the spring fingers during connector assembly. When assembled, the insulator provides an inward bias upon the spring fingers and improved support of the inner contact to inner conductor interconnection.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention, together with a general description of the invention given above, and the detailed description of the embodiments given below, serve to explain the principles of the invention. Like reference numbers in the drawing figures refer to the same feature or element and may not be described in detail for every drawing figure in which they appear.

DETAILED DESCRIPTION

Figure 1:
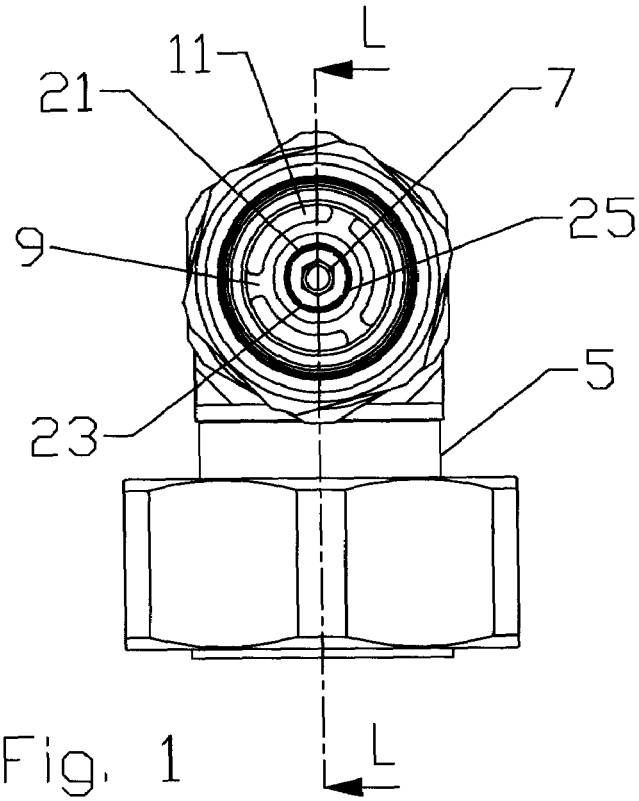
FIG. 1 is a schematic cable end view of a first exemplary embodiment of an angled connector demonstrated with a right angle connector configuration.

Connector end 1 and cable end 3 are each applied herein as side identifications for individual elements of the connector 5 along a path through the connector 5 between the cable connection and an interface of the connector, to provide position references for element features described and inter-element contacting surface clarification.

Analyzing the prior inner contact 7 configurations, the inventor has recognized several drawbacks of a movable insulator as a bias mechanism for the inner contact. Dimensional variations of outer conductors of different materials, production runs and or manufacturer's may be significant. Also, the shape of the flare applied to the outer conductor is dependent upon the specific flare tool used and flaring force that is applied. Because of the wide range of these variances, the final longitudinal position of the movable insulator may vary significantly when the connector is assembled, resulting in a varying degree of inward bias by the spring fingers upon the inner conductor. A varying degree of inward bias may unacceptably change the characteristics of the interconnection between the spring fingers and the inner conductor.

An inner contact 7 arrangement according to the invention has a cable end bias insulator 9 that is preferably longitudinally stationary but which provides a graduated insertion force characteristic and also compensates for varied inner conductor dimensions.

Figure 2:
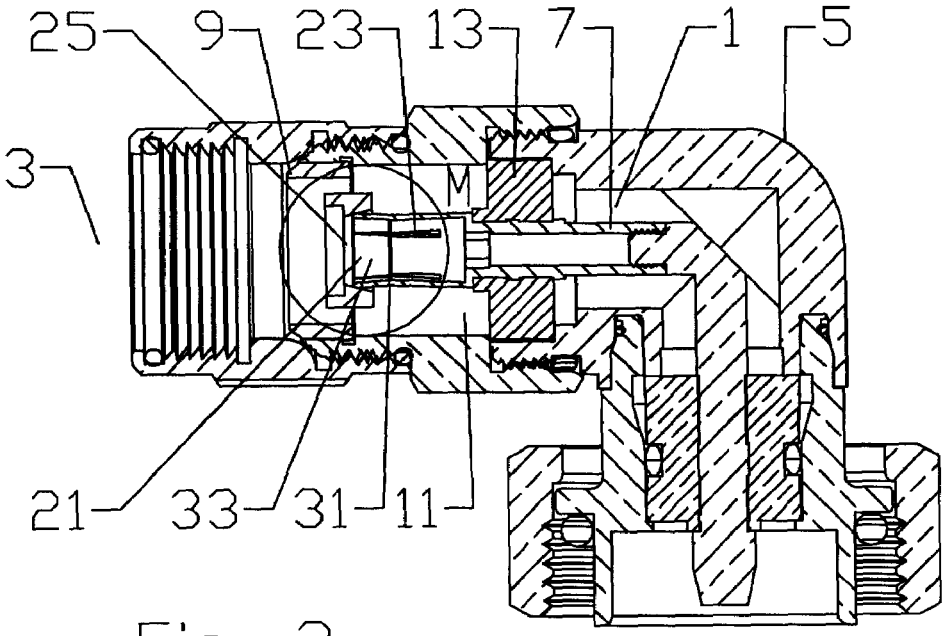
FIG. 2 is a schematic cut-away side view along line L-L of FIG. 1.
Figure 3:
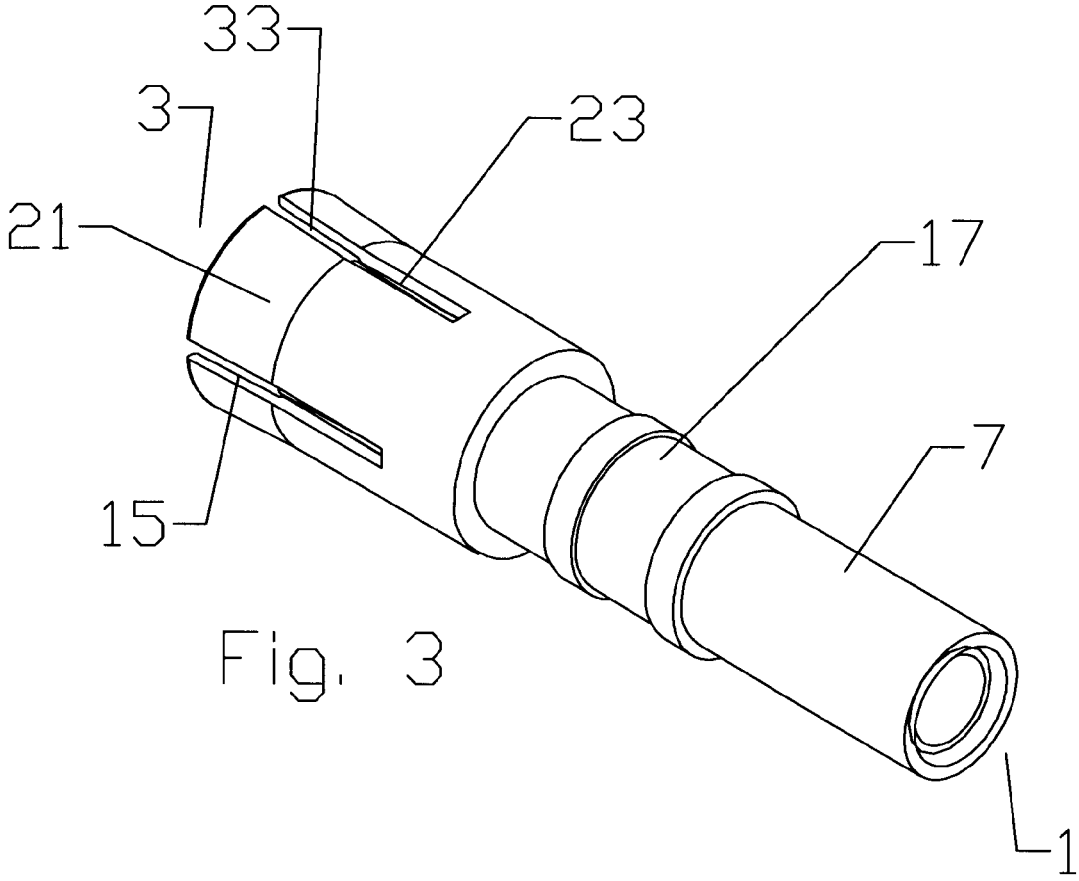
FIG. 3 is a schematic angled isometric view of the inner contact of FIG. 2.
Figure 4:
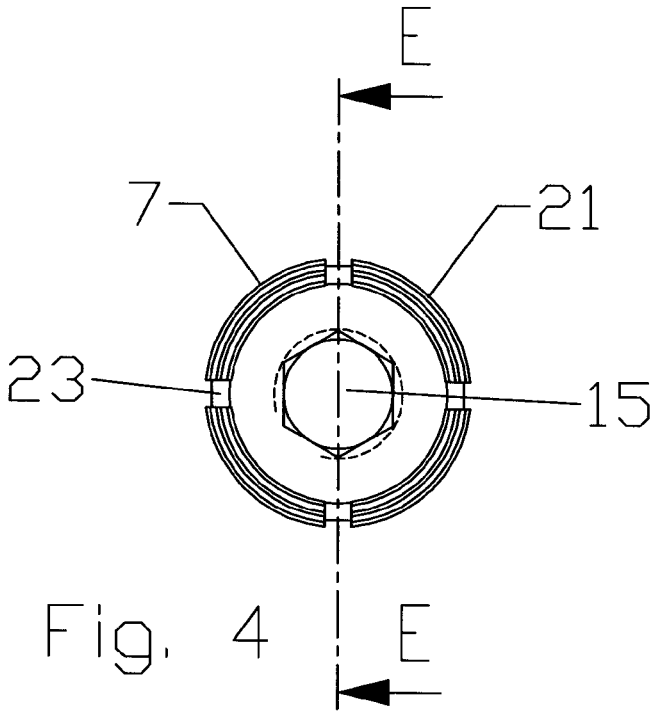
FIG. 4 is a schematic cable end view of FIG. 3.
Figure 5:
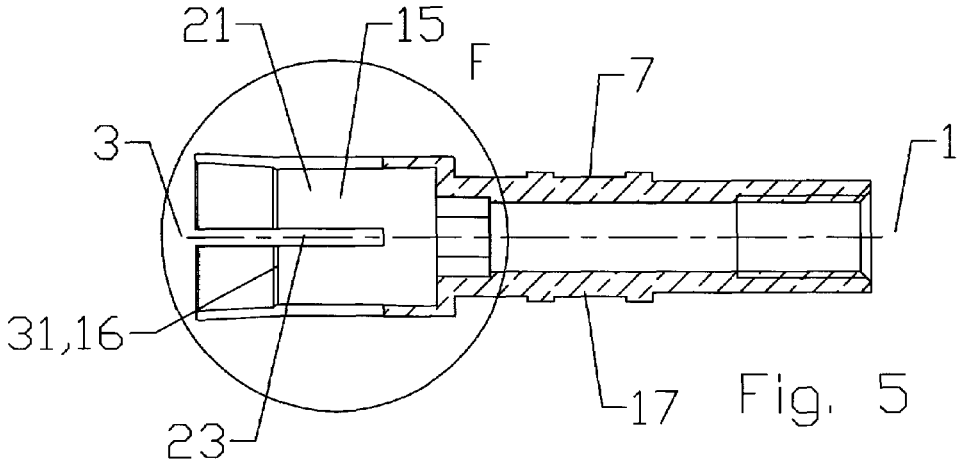
FIG. 5 is a schematic cut-away side view along line E-E of FIG. 4.
Figure 6:
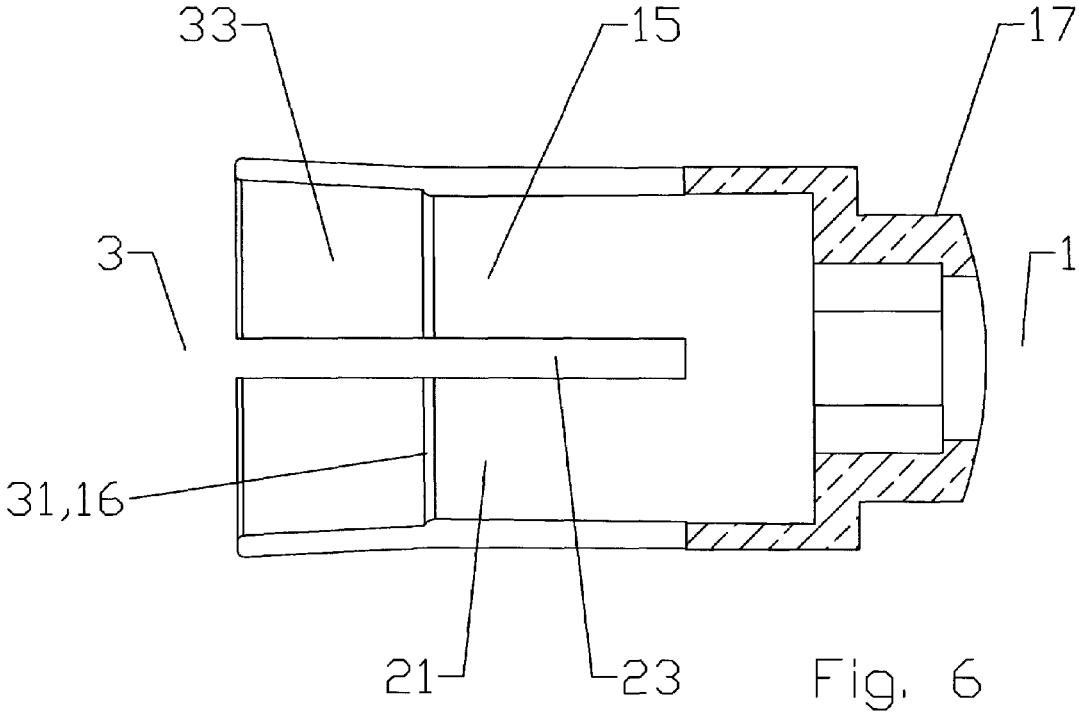
FIG. 6 is an enlarged view of area F of FIG. 5.
Figure 7:
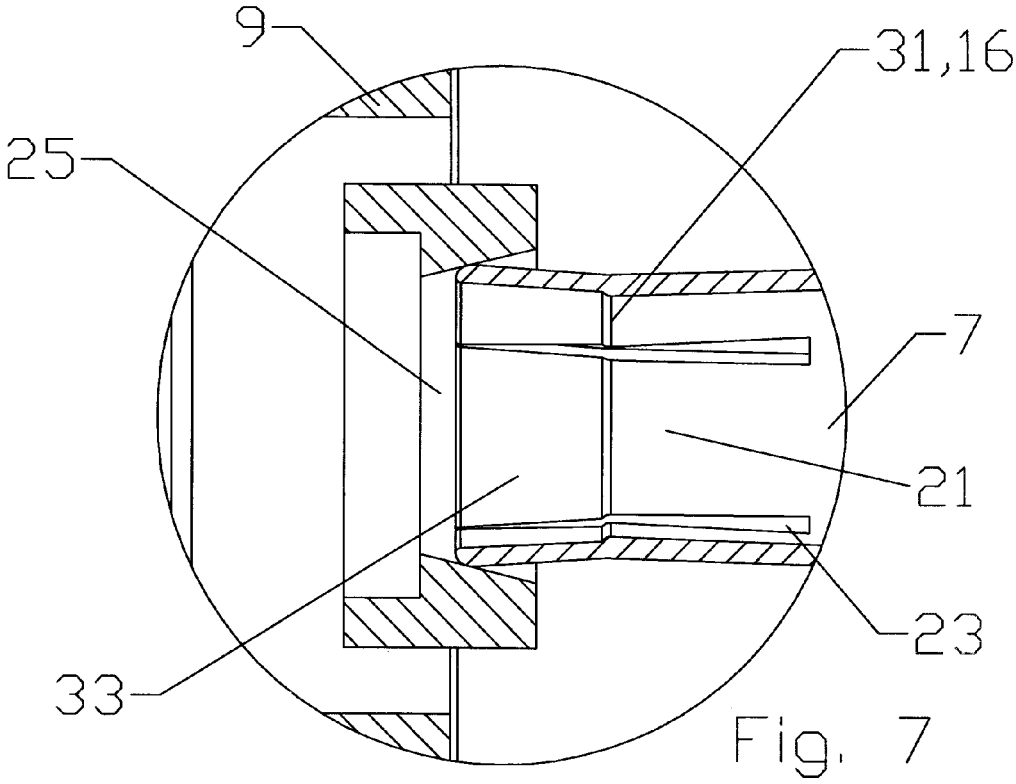
FIG. 7 is an enlarged view of area M of FIG. 2.

As shown in FIGS. 1 and 2, an inner contact 7 is supported coaxially within the connector bore 11 of a connector 5 by a support insulator 13. As shown in FIGS. 3-6, a spring basket 15 of the inner contact 7 extending towards the cable end 3 from a central portion 17 of the inner contact 7 is open to the cable end 3 for receiving the inner conductor 19. The spring basket 15 is formed by a plurality of spring fingers or tines 21 arrayed around the outer diameter of the inner contact 7, defined and separated from one another by slot(s) 23. As best shown in FIG. 7, a bias insulator 9 formed with a generally cone shaped ramp bore 25 is insertable into the connector bore 11, for example from the cable end 3 to engage the spring basket 15 and bias it inward as the cable end 3 of the tine(s) 21 progressively engages the ramp bore 25. The bias insulator 9 seats within the connector bore 11, retained in place, for example, via a press fit. Alternatively, a snap-into-place retention mechanism, such as tabs into sockets and or an annular protrusion 27 of the bias insulator 9 outer diameter that mates with and is retained within an annular groove 29 formed in the sidewall 31 of the connector bore 11, may be employed.

As best shown in FIGS. 3-6, an inward projecting step or shoulder 31 may be formed on the inner diameter sidewall of the spring basket 15 at a transition 16 between the tine(s) 21 extending from the central portion 17 and a guide surface 33 is preferably spaced inward of the cable end 3 of each of the tine(s) 21. The longitudinal position of the shoulder 31 and or transition 16 may be, for example, within a middle third of the longitudinal length of the tine(s) 21. The portion of the tine(s) 21 at a cable end 3 side of the transition 16, and shoulder 31 if present, may be arranged angled outward from a longitudinal axis of the inner contact 7. When seated within the connector bore 11, the bias insulator 9 swages the tine(s) 21 of the spring basket 15 inward, as best shown in FIG. 7.

Because the tine(s) 21 are swaged during the mounting operation of the bias insulator 9 into the connector bore 11, the time and expense of performing the conventional swage manufacturing step upon the tine(s) 21 has been eliminated. Preferably, the swaged position of the tine(s) 21 forms a spring basket cavity having an inner diameter between the cable end 3 and the shoulder 31 that is greater than the inner diameter of the shoulder 31, the inner diameter decreasing towards the shoulder 31. The decreasing inner diameter forms the guide surface 33 for the inner conductor 19 as it is inserted within the spring basket 15. Where no shoulder 31 is present, the inner diameter decreases until reaching a transition at the end of the guide surface 33.

Figure 8:
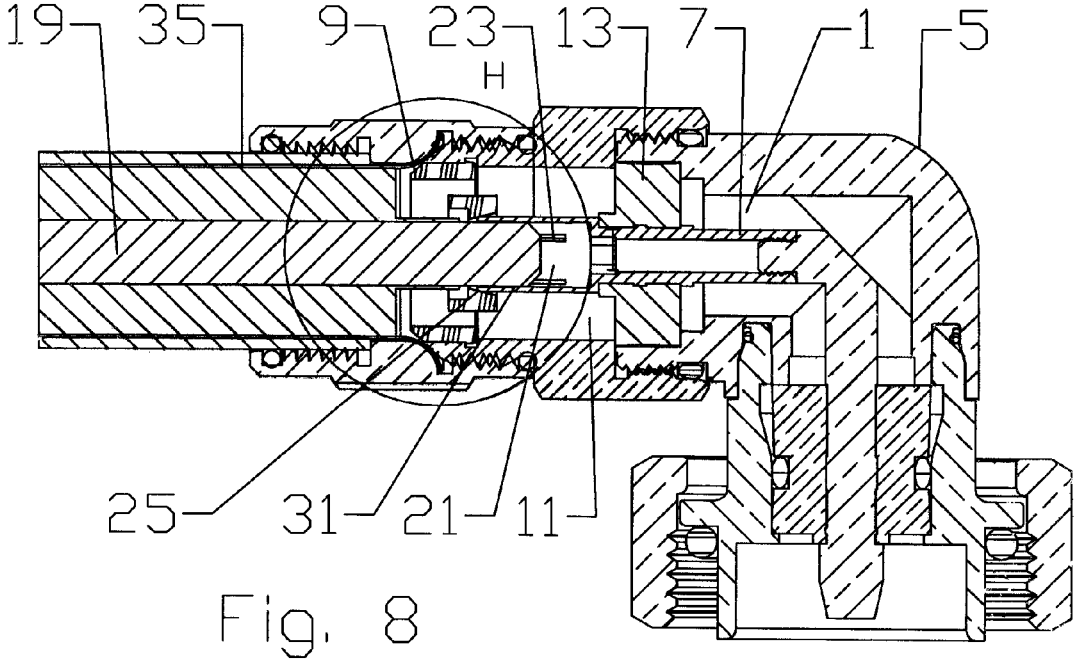
FIG. 8 is a schematic view of FIG. 2, with a coaxial cable installed upon the connector.
Figure 9:
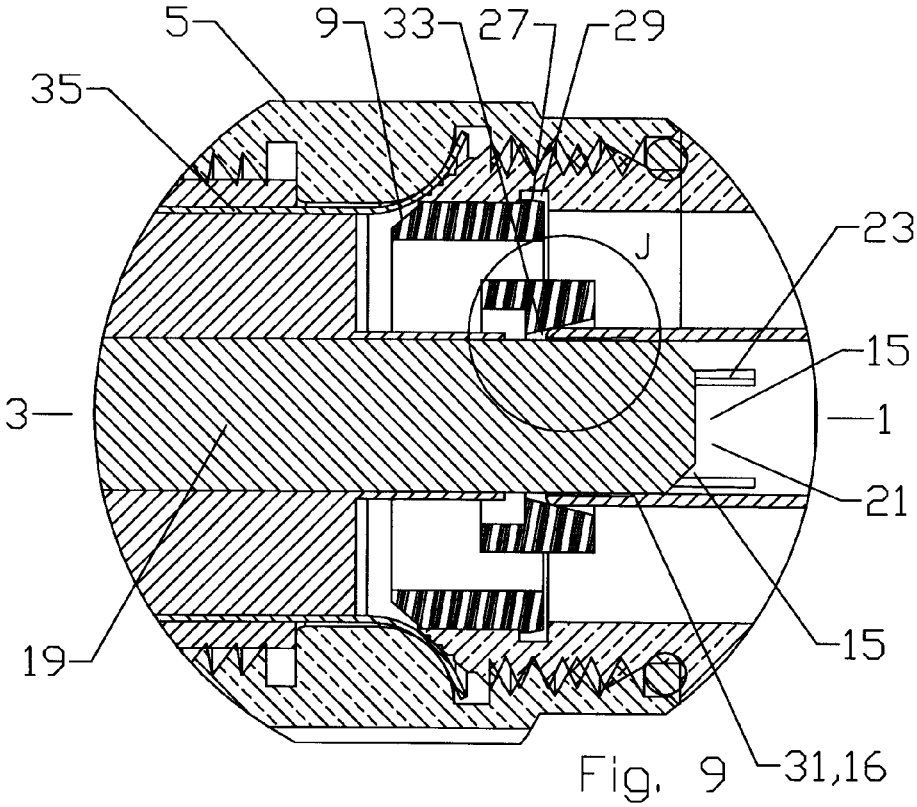
FIG. 9 is an enlarged view of area H of FIG. 8.
Figure 10:
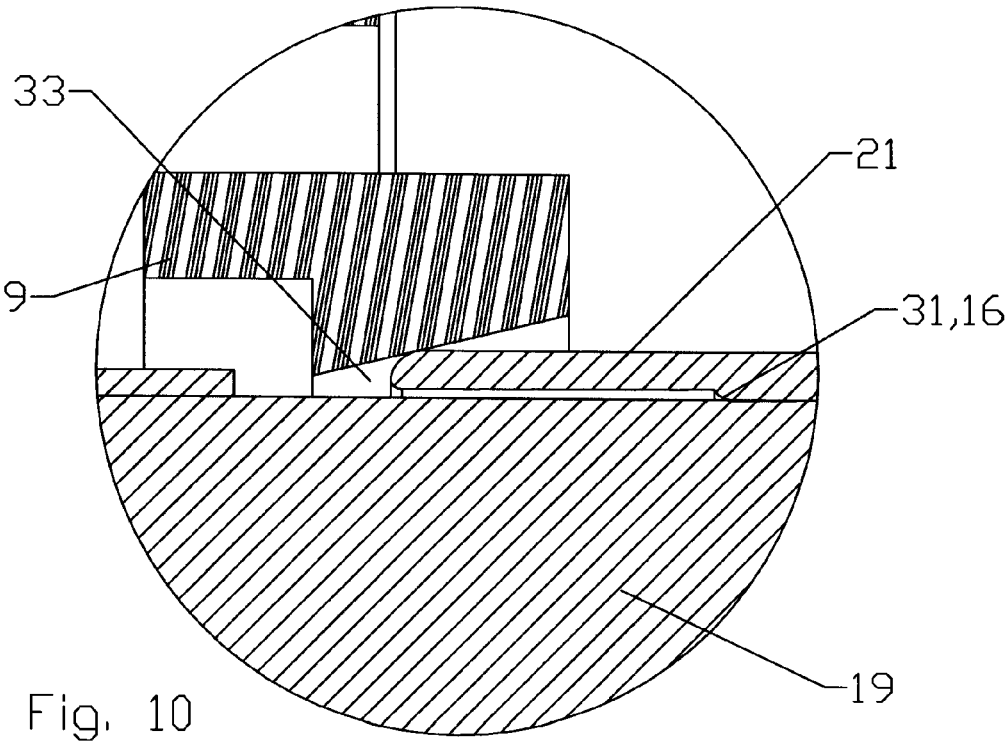
FIG. 10 is an enlarged view of area J of FIG. 9.

As shown in FIGS. 8-10, during inner conductor 19 insertion into the spring basket 15 the inner conductor 19 is guided and centered by the guide surface 33. Rather than abutting the end of a spring basket 15 that requires the full insertion force to move past the first point of contact, insertion resistance gradually increases as the inner conductor moves along the guide surface 33 approaching the shoulder 31. The gradual nature of the guide surface 33 also enables insertion with reduced binding of an inner conductor 19 that has not been chamfered, simplifying the cable preparation requirements. Because of the graduated increase in required insertion force, scraping of the inner conductor 19 by the tine(s) 21 along the full insertion length may be reduced, thereby reducing the possibility of generating metal shaving(s) associated with PIM distortion.

To seat under the shoulder 31, the tine(s) 21 are further flexed outward, bending against the connection of the tine(s) 21 to the inner contact central portion 17 and between the cable end 3 of the tine(s) 21 that are swaged by the ramp bore 25.

The flexing between dual ends of the tine(s) 21 creates a bowing of the tine(s) 21 between dual points rather than a conventional deflection from a single pivot point. The location of the shoulder 31, spaced inward from the cable end 3 of the tine(s) 21, enables the bowing to occur with two point effect, rather than acting directly upon the cable end 3 of the tine(s) 21, only.

The bowing creates a significantly increased bias upon the inner conductor 19 without requiring the tine(s) 21 to be provided with an increased cross section, compared to a conventional configuration where tine deflection is occurring from only a single point.

A preferred dimensioning between the assembled spring basket 15, shoulder 31 and inner conductor 19 diameter is demonstrated in FIGS. 8-10. The bowing of the tine(s) 21 has resulted in a deflection of the cable end 3 of the tine(s) 21 that is short of contacting the inner conductor 19 except at the shoulder 31. This results in a very strong interconnection having a single longitudinal point of contact, which will reduce PIM distortion generation should the inner conductor 19 move with respect to the body of the connector 5, for example under tension or thermal expansion and contraction.

The length of the guide surface 33 and the location along the tine(s) 21 of the shoulder 31, when a shoulder 31 is applied, may be selected as a compromise between the point of full engagement and the flexibility required to accommodate the smallest and largest inner conductor 19 diameters. This length is directly related to the stiffness of the tine(s) 21 that is determined by the slot 23 length defining each tine 21, the thickness of the tine(s) 21, the material used and the arc width of the tine(s) 21. In the exemplary embodiments described herein, common conductive spring metals such as phosphor bronze have been applied with an arc angle between tines of approximately 83 degrees (four slot(s) 23); a preferred length of each tine 21 is approximately 3 to 8 times the tine 21 thickness.

One skilled in the art will appreciate that the guide surface 33 inner diameter at the cable end 3 and the inner diameter at the shoulder 31 when the bias insulator 9 initially swages the tine(s) 21 inward (see FIG. 7) defines an increased range of inner conductor 19 diameters that an inner contact 7 arrangement according to the invention can interconnect with. To account for a shortening of the tine (21) with respect to a longitudinal length as significant bowing occurs, the cable end 3 of the tine(s) 21 is movable along the ramp bore 25, further increasing the range of inner conductor 19 diameters that the inner contact 7 may receive.

In further embodiment(s), because the bias insulator 9 is not required to be movable, the inner contact 19 may be similarly applied to connectors that utilize a permanent interconnection such as a press fit and or soldered connection with the outer conductor 35, instead of a removable mechanical clamp upon the outer conductor 35 leading edge applied, for example, by threading a coupling nut upon the connector 5 body.

Figure 11:
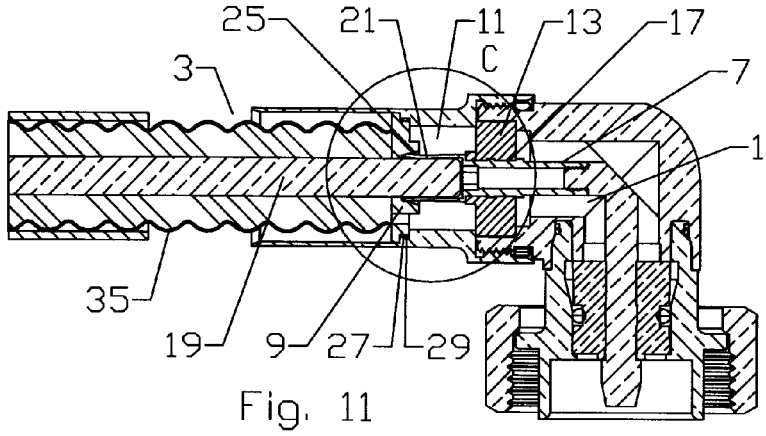
FIG. 11 is a schematic cut-away side view of an alternative connector embodiment, with a coxial cable installed.
Figure 12:
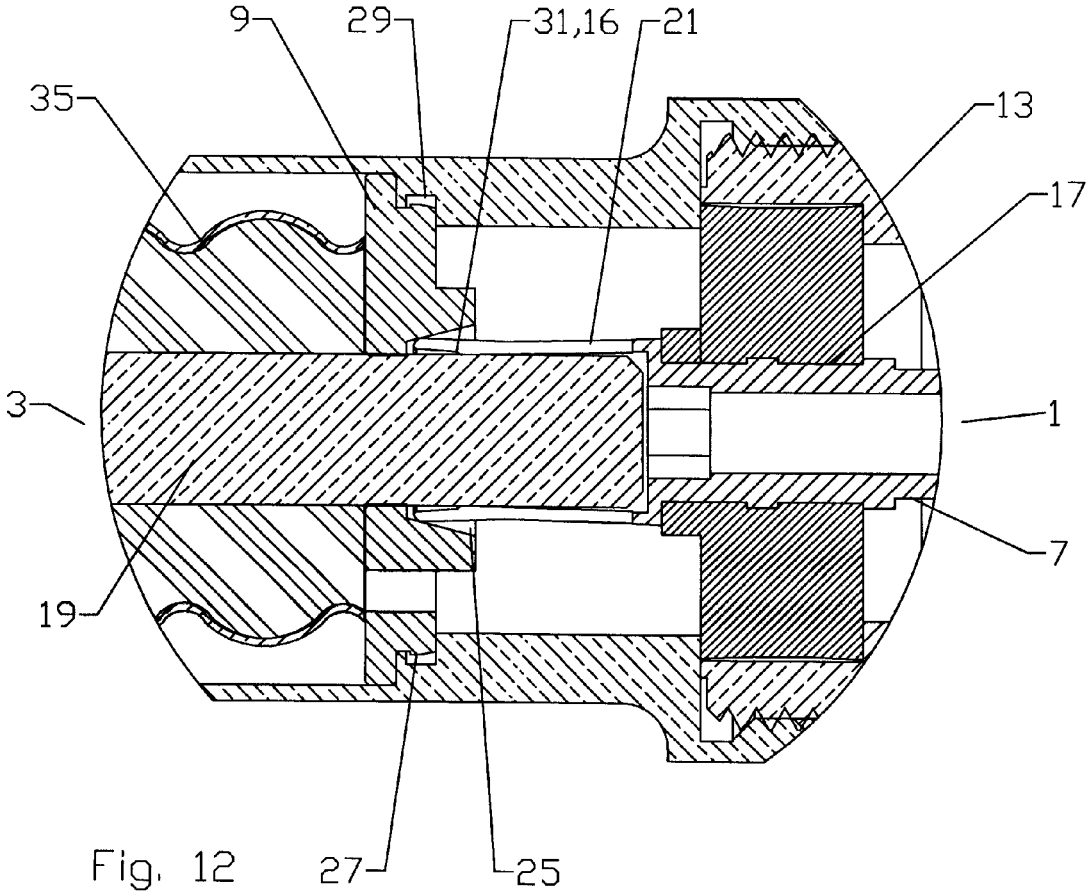
FIG. 12 is an enlarged view of area C of FIG. 11.

FIGS. 11 and 12 demonstrate a solder connection embodiment. Here, the bias insulator 9 is formed without insulator material reducing slots to also operate as a solder barrier, preventing solder flow during the soldering step that could otherwise enable solder flow that may create an inward solder projection impedance discontinuity or short between the outer conductor 35 and the inner conductor 19.

The invention has been demonstrated with right angle configuration connectors. One skilled in the art will recognize that the inner contact 7 and bias insulator 9 may be similarly applied to in-line connector configurations, for example where the connector end 1 of the inner contact 7 is formed as or further coupled to a pin according to the desired standard or proprietary connector interface.

The invention provides a cost effective inner contact with improved electrical performance and increased cable dimensional variation compatibility. Further, the inner contact does not require the swaging operation during manufacture that is typical of the prior inner contacts, reducing the cost of manufacture.

Table of Parts

| | |
|---|---|
| 1 | connector end |
| 3 | cable end |
| 5 | connector |
| 7 | inner contact |
| 9 | bias insulator |
| 11 | connector bore |
| 13 | support insulator |
| 15 | spring basket |
| 16 | transition |
| 17 | central portion |
| 19 | inner conductor |
| 21 | tine |
| 23 | slot |

-continued

| Table of Parts | |
|---|---|
| 25 | ramp bore |
| 27 | annular protrusion |
| 29 | annular groove |
| 31 | shoulder |
| 33 | guide surface |
| 35 | outer conductor |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An inner contact arrangement for a coaxial cable connector, comprising:

an inner contact supported coaxially within a connector bore of the connector by a support insulator;

a plurality of tines extending from a central portion of the inner contact, a cable end of the tines angled outward from a longitudinal axis of the inner contact;

a bias insulator with a ramp bore, the bias insulator retained within the connector bore;

the cable end of the tines contacting the ramp bore.

2. The arrangement of claim 1, further including a shoulder on an inner surface of the tine(s), the shoulder spaced away from the cable end of the tines by a guide surface.

3. The arrangement of claim 1, wherein the ramp bore has an increasing diameter in a direction from a cable end side to a connector end side.

4. The arrangement of claim 1, wherein the outward angle of the tines begins at a position spaced away from a connector end of the tines.

5. The arrangement of claim 1, wherein the tines are separated from each other by slots; the slots defining a longitudinal length of the tine(s).

6. The arrangement of claim 1, wherein the bias insulator has an annular protrusion on an outer diameter; the annular protrusion retained within an annular groove of the connector bore.

7. The arrangement of claim 1, wherein the bias insulator is retained stationary within the connector bore.

8. The arrangement of claim 1, wherein the outward angle of the tines begins at a transition spaced away from a connector end of the tines; and further comprising a shoulder on an inner surface of the tine(s), the shoulder positioned longitudinally along the tine(s) at the transition.

9. The arrangement of claim 1, wherein a length of the tine(s) is between 3 and 8 times a radial thickness of the tine(s).

10. The arrangement of claim 1, wherein the contacting between the cable end of the tines and the ramp bore swages the tines inward.

11. An inner contact arrangement for a coaxial cable connector, comprising:

an inner contact supported coaxially within a connector bore of the connector by a support insulator;

a plurality of tines extending from a central portion of the inner contact;

a shoulder on an inner surface of the tine(s), the shoulder spaced away from a cable end of the tines by a guide surface;

a bias insulator with a ramp bore, the bias insulator retained within the connector bore;

the cable end of the tine(s) contacting the ramp bore.

12. The arrangement of claim 11, wherein the shoulder is located within a middle third of the longitudinal length of the tine(s).

13. The arrangement of claim 11, wherein the tine(s) are angled outward between the shoulder and the cable end of the tine(s).

14. The arrangement of claim 11, wherein a thickness of the tine(s) is reduced between the shoulder and the cable end of the tine(s).

15. The arrangement of claim 11, wherein the tine(s) are swaged inward by the ramp bore.

16. The arrangement of claim 11, wherein the bias insulator is a solder barrier between a cable end side and a connector end side.

17. An inner contact arrangement for a coaxial cable connector, comprising:

an inner contact supported coaxially within a connector bore of the connector by a support insulator;

a plurality of tines extending from a central portion of the inner contact;

a shoulder on an inner surface of the tine(s), the shoulder located within a middle third of a longitudinal length of the tine(s);

the tine(s) angled outward between the shoulder and a cable end of the tine(s);

a bias insulator with a ramp bore;

the bias insulator retained stationary within the connector bore; and the cable end of the tine(s) swaged inward by the ramp bore.

18. The arrangement of claim 17, wherein the length of the tine(s) is between 3 and 8 times a radial thickness of the tine(s).

19. The arrangement of claim 17, wherein a radial thickness of the tine(s) is reduced between the cable end and the shoulder.

* * * * *